US009891566B1

(12) United States Patent
Takahashi

(10) Patent No.: US 9,891,566 B1
(45) Date of Patent: Feb. 13, 2018

(54) FIXING DEVICE AND IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Kazutoshi Takahashi, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/459,101

(22) Filed: Mar. 15, 2017

(30) Foreign Application Priority Data

Feb. 6, 2017 (JP) ..... 2017-019702

(51) Int. Cl.
*G03G 15/20* (2006.01)

(52) U.S. Cl.
CPC ..... *G03G 15/2089* (2013.01)

(58) Field of Classification Search
CPC ..... G03G 15/2067; G03G 15/2089
See application file for complete search history.

(56) References Cited

U.S. PATENT DOCUMENTS

| | | | | |
|---|---|---|---|---|
| 8,626,018 | B2 | 1/2014 | Ogawa et al. | |
| 8,971,746 | B2 | 3/2015 | Hasegawa et al. | |
| 9,274,473 | B2 * | 3/2016 | Mogi | G03G 15/2053 |
| 2007/0019978 | A1 * | 1/2007 | Kim | G03G 15/2064 399/67 |
| 2015/0338807 | A1 * | 11/2015 | Tanaka | G03G 15/2085 399/122 |

* cited by examiner

*Primary Examiner* — Gregory H Curran
(74) *Attorney, Agent, or Firm* — Amin, Turocy & Watson LLP; Gregory Turocy

(57) ABSTRACT

A fixing device according to an embodiment includes a first rotating body, a pressing unit, an urging member, a base body section, a screw shaft section, and a rotation regulating section. The pressing unit includes a belt, a second rotating body, and a supporting frame. The supporting frame supports the second rotating body. The urging member urges the pressing unit in a direction in which the second rotating body approaches the first rotating body. The base body section is rotatable around an axis. The shape of a cross section of the base body section orthogonal to an axial direction is a noncircular shape. The screw shaft section projects from the base body section and regulates a movement of the pressing unit in a direction in which the pressing unit approaches the first rotating body. The rotation regulating section comes into contact with the outer surface of the base body section to regulate the rotation of the base body section.

10 Claims, 7 Drawing Sheets

FIXING DEVICE AND IMAGE FORMING APPARATUS

CROSS-REFERENCE TO RELATED APPLICATIONS

This application is based upon and claims the benefit of priority from Japanese Patent Application No. 2017-019702, filed Feb. 6, 2017, the entire contents of which are incorporated herein by reference.

FIELD

Embodiments described herein relate generally to a fixing device and an image forming apparatus.

BACKGROUND

A fixing device includes a heating roller and a pressing unit. The pressing unit includes a pressurizing belt and a pressurizing roller. The outer circumferential surface of the pressurizing roller is covered with a rubber layer. The pressing unit presses a sheet against the heating roller to thereby thermally fix toner to the sheet.

In the fixing device, if the rubber layer of the pressurizing roller is deteriorated by aging, in some case, a nip width increases, creases occur on the sheet, and the sheet tilts.

DETAILED DESCRIPTION

In general, according to one embodiment, a fixing device includes a first rotating body, a pressing unit, an urging member, a base body section, a screw shaft section, and a rotation regulating section. The first rotating body is heated by a heat source. The pressing unit includes a belt, a second rotating body, and a supporting frame. The belt is opposed to the outer circumferential surface of the first rotating body. The belt is wound around the outer circumferential surface of the second rotating body. The supporting frame supports the second rotating body. The urging member urges the pressing unit in a direction in which the second rotating body approaches the first rotating body. The base body section is rotatable around an axis. The shape of a cross section of the base body section orthogonal to an axial direction is a noncircular shape. The screw shaft section projects from the base body section and regulates a movement of the pressing unit in a direction in which the pressing unit approaches the first rotating body. The rotation regulating section comes into contact with the outer surface of the base body section to regulate the rotation of the base body section.

A fixing device and an image forming apparatus in an embodiment are explained below with reference to the drawings.

Figure 1:
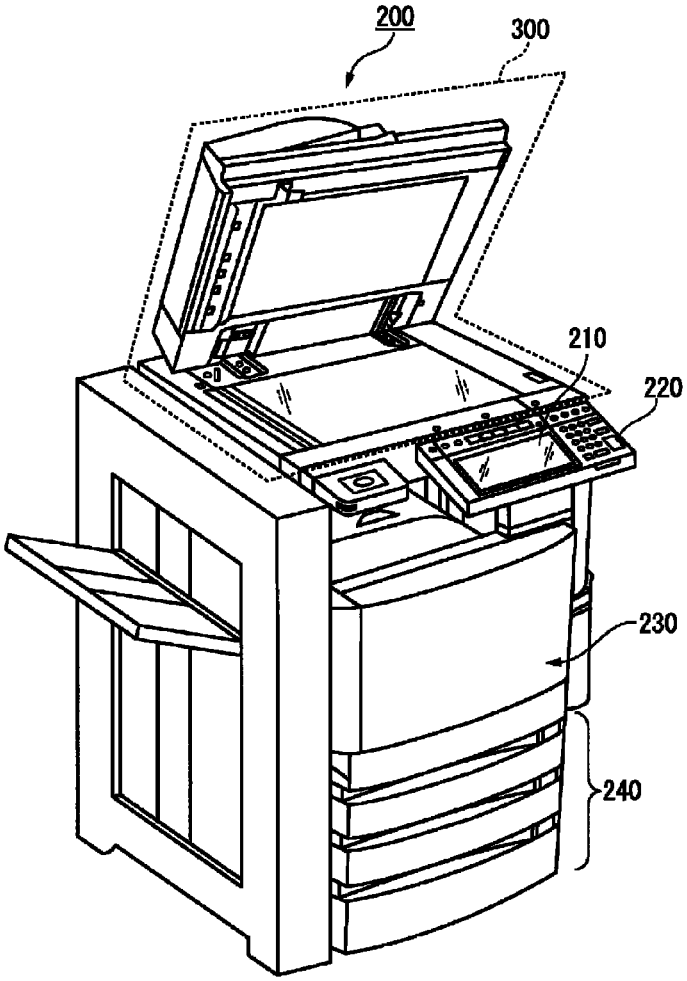
FIG. 1 is an exterior view showing an image forming apparatus in an embodiment.

FIG. 1 is an exterior view showing an overall configuration example of an image forming apparatus 200 in the embodiment. For example, the image forming apparatus 200 is a multifunction peripheral. The image forming apparatus 200 includes a display 210, a control panel 220, a printer section 230, a sheet storing section 240, and an image reading section 300.

The image forming apparatus 200 forms an image on a recording medium such as a sheet using a developer such as toner. For example, the sheet is paper or label paper. The sheet is not particularly limited as long as the image forming apparatus 200 can form an image on the surface of the sheet.

The display 210 is an image display device such as a liquid crystal display or an organic EL (Electro Luminescence) display. The display 210 displays various kinds of information concerning the image forming apparatus 200.

The control panel 220 includes a plurality of buttons. The control panel 220 receives operation by a user. The control panel 220 outputs a signal corresponding to the operation performed by the user to a control section of the image forming apparatus 200. Note that the display 210 and the control panel 220 may be configured as an integral touch panel.

The printer section 230 forms an image on the sheet on the basis of image information generated by the image reading section 300 or image information received via a communication path. For example, the printer section 230 forms an image according to processing explained below. An image forming section of the printer section 230 forms an electrostatic latent image on a photosensitive drum on the basis of the image information. The image forming section of the printer section 230 forms a visible image by causing a developer to adhere to the electrostatic latent image. Toner is a specific example of the developer. A transfer section of the printer section 230 transfers the visible image onto the sheet. A fixing section of the printer section 230 performs heating and pressurizing on the sheet to thereby fix the visible image on the sheet. Note that the sheet on which the image is formed may be a sheet stored in the sheet storing section 240 or may be a manually fed sheet.

The sheet storing section 240 stores sheets used for the image formation in the printer section 230.

The image reading section 300 reads reading target image information as contrast of light. The image reading section 300 records the read image information. The recorded image information may be transmitted to other image processing apparatuses via a network. The recorded image information may be formed as an image on the sheet by the printer section 230.

Figure 2:
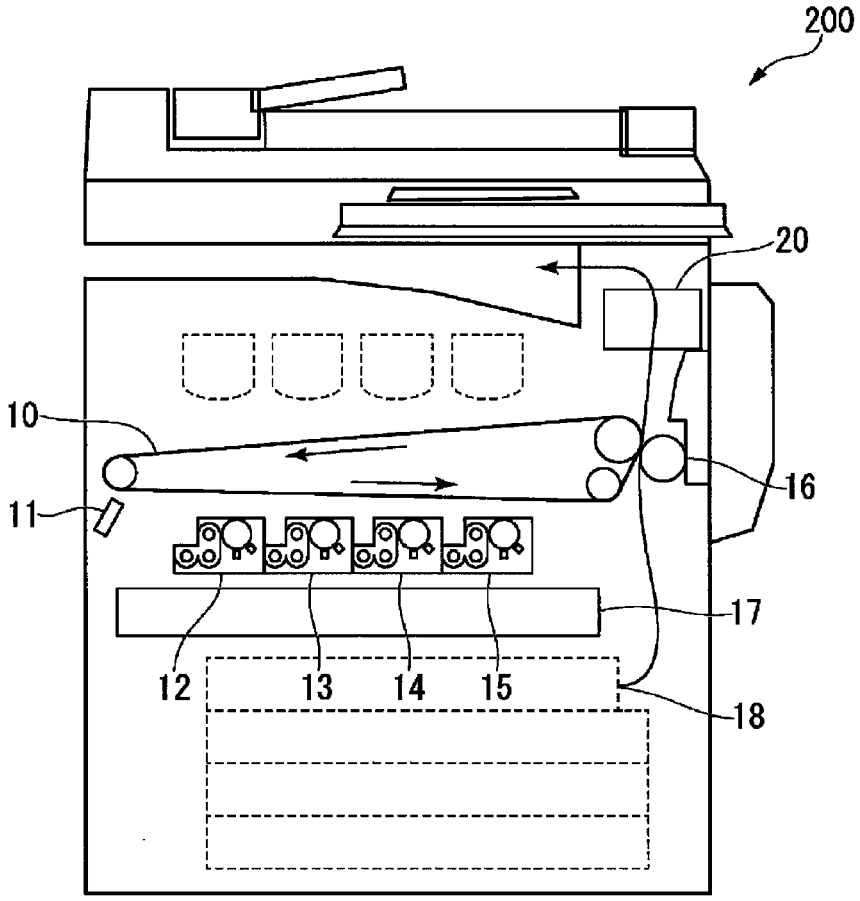
FIG. 2 is a diagram showing a schematic configuration of the image forming apparatus.

FIG. 2 is a diagram showing an example of a schematic configuration of the image forming apparatus 200. The image forming apparatus 200 shown in FIG. 2 is an image forming apparatus of an electrophotographic system. The image forming apparatus 200 includes an intermediate transfer body 10, a blade 11 (a toner removing section), image forming sections 12 to 15, a secondary transfer roller 16, a control section 17, a paper feeding section 18, and a fixing device 20.

The intermediate transfer body 10 is an endless belt. The intermediate transfer body 10 rotates in a direction of an arrow shown in FIG. 2.

The blade 11 removes excess toner adhering on the intermediate transfer body 10.

The image forming sections 12 to 15 form images on the intermediate transfer body 10 using toners of respective colors (in the example shown in FIG. 2, four colors).

The secondary transfer roller 16 transfers the images made with the toners formed on the intermediate transfer body 10 onto the sheet.

The control section 17 controls the image forming sections 12 to 15 and the fixing device 20.

The paper feeding section 18 feeds the sheet.

The fixing device 20 heats and pressurizes the images made with the toners transferred onto the sheet to fix the images on the sheet.

The image forming apparatus 200 converts image data to be formed into image data of the colors through image processing. For example, the image forming apparatus 200 converts the image data into image data of colors of yellow (Y), magenta (M), cyan (C), and black (K).

The image forming apparatus 200 executes a first transfer process and a second transfer process. In the first transfer process, the image forming sections 12 to 15 multiple-transfer the images made with the toners of the colors onto the intermediate transfer body 10 to lay the images one on top of another. In the second transfer process, the secondary transfer roller 16 collectively transfers the images made with the toners on the intermediate transfer body 10 onto the sheet.

The sheet is delivered from the paper feeding section 18 and conveyed through a sheet conveyance path. The sheet is discharged to a paper discharge tray after passing through the secondary transfer roller 16 and the fixing device 20.

Figure 3:
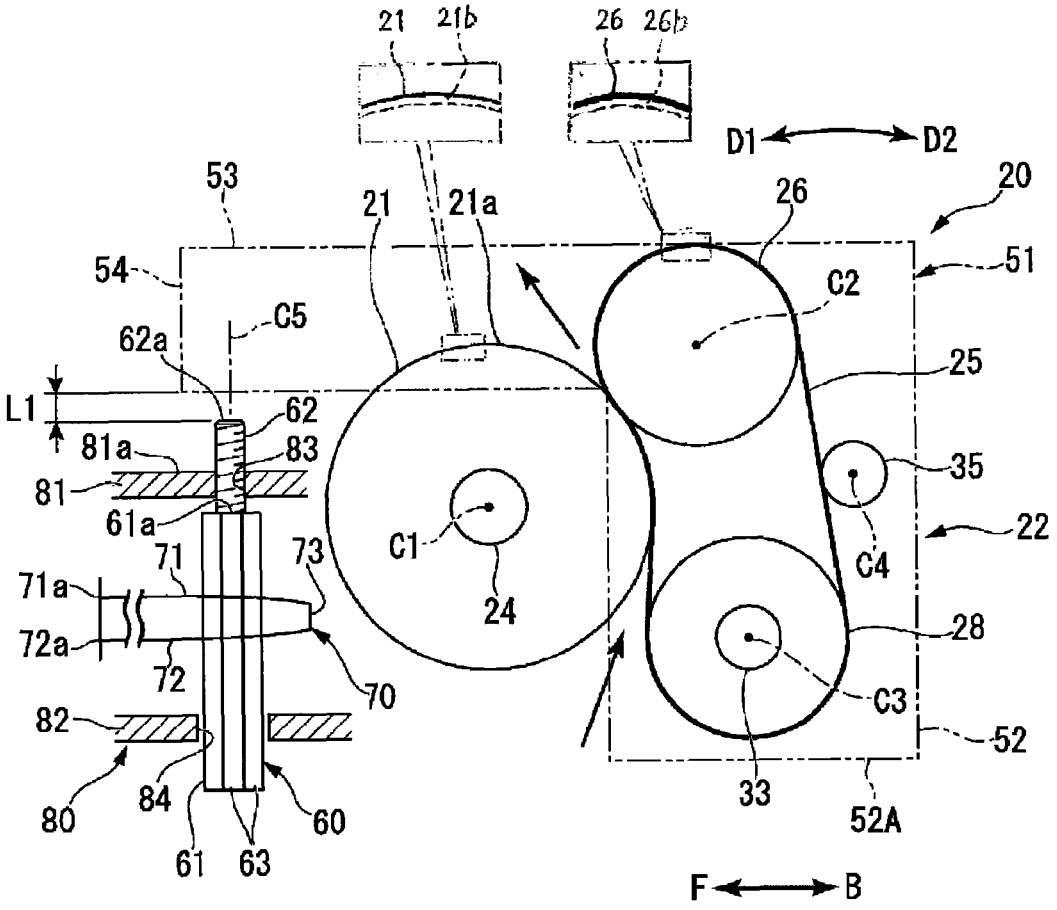
FIG. 3 is a diagram showing a schematic configuration of a fixing device in the embodiment.
Figure 4:
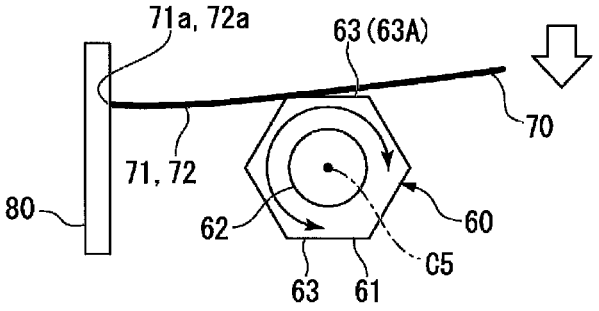
FIG. 4 is a diagram showing a schematic configuration of a stopper section and a rotation regulating section of the fixing device.
Figure 5:
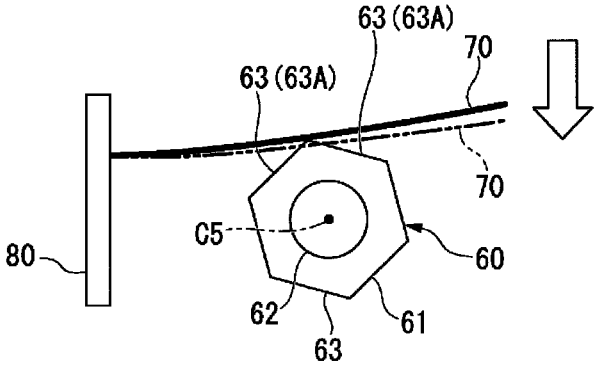
FIG. 5 is a diagram showing the schematic configuration of the stopper section and the rotation regulating section of the fixing device.
Figure 6:
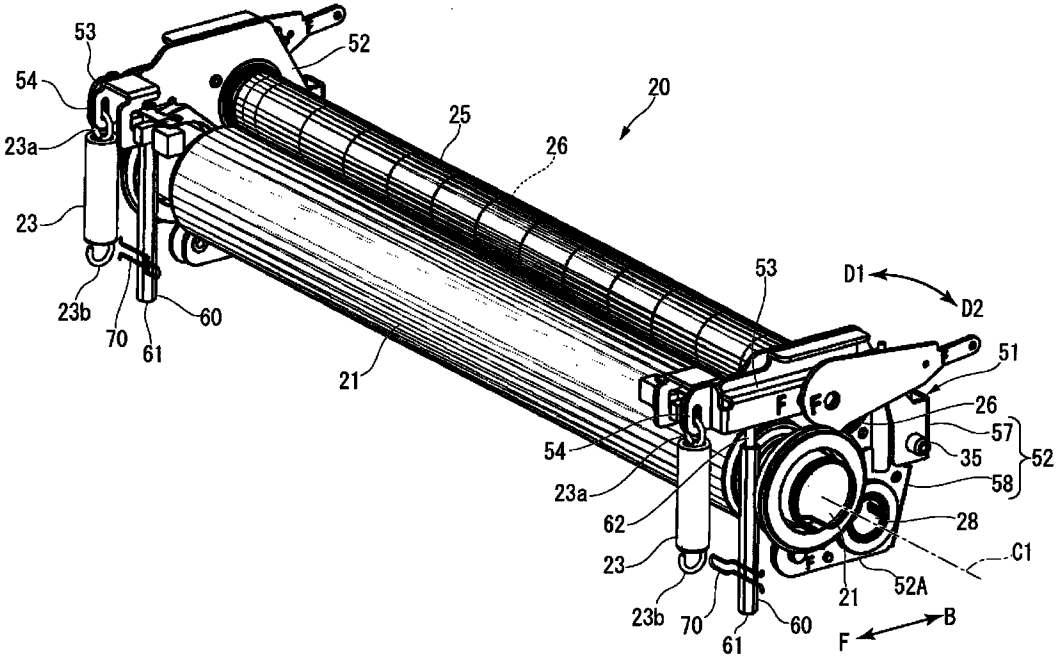
FIG. 6 is a perspective view showing the fixing device.
Figure 7:
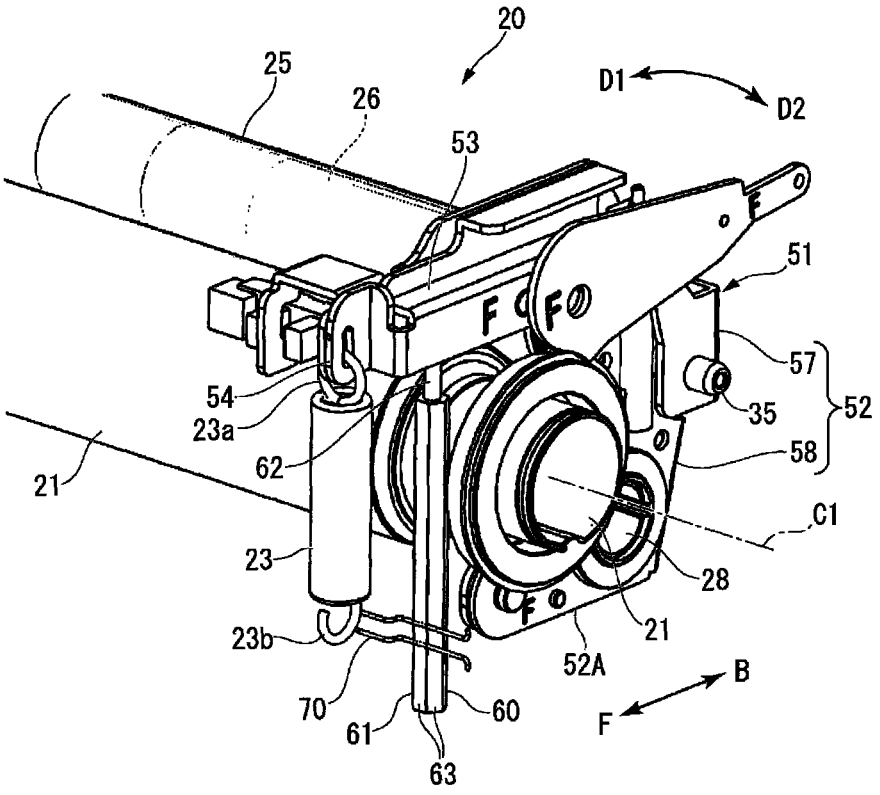
FIG. 7 is a perspective view showing a part of the fixing device.

FIG. 3 is a diagram showing a schematic configuration of the fixing device 20 shown in FIG. 2. FIGS. 4 and 5 are diagrams showing a schematic configuration of a stopper section 60 and a rotation regulating section 70 of the fixing device 20. FIG. 6 is a perspective view showing the fixing device 20. FIG. 7 is a perspective view showing a part of the fixing device 20.

As shown in FIG. 3, the fixing device 20 includes a heat roller 21 (a first rotating body), a pressing unit 22, an urging member 23 (see FIG. 6), a pair of supporting frames 51, a pair of stopper sections 60, a pair of rotation regulating sections 70, and a fixed frame 80.

The heat roller 21 is a cylinder body made of metal such as aluminum or iron. The outer circumferential surface of the heat roller 21 is covered with a release layer 21*b* (a coating layer 21*b*). For example, the release layer 21*b* is made of, for example, an elastic material such as fluorocarbon resin or silicon rubber. The heat roller 21 incorporates a lamp 24 (a heat source). The heat roller 21 is heated by the lamp 24. For example, the lamp 24 is a halogen lamp, an IH heater, or the like.

The pressing unit 22 includes a pressurizing belt 25, a pressurizing roller 26 (a second rotating body), and a pressurizing belt heat roller 28 (a belt supporting member).

The pressurizing belt 25 is an endless belt. The pressurizing belt 25 is wound around the outer circumferential surface of the pressurizing roller 26 and the outer circumferential surface of the pressurizing belt heat roller 28. The pressurizing belt 25 rotates following the heat roller 21. The pressurizing belt 25 is opposed to an outer circumferential surface 21*a* of the heat roller 21. The pressurizing belt 25 is brought into pressurized contact with the heat roller 21 by the pressurizing roller 26. A fixing nip section is formed between the pressurizing belt 25 and the heat roller 21 by the pressurized contact.

The pressurizing roller 26 is a cylinder body made of metal such as stainless steel. A coating layer 26*b* is formed on the outer circumferential surface of the pressurizing roller 26. The coating layer 26*b* is made of, for example, an elastic material such as fluorocarbon resin or silicon rubber. The pressurizing roller 26 presses the pressurizing belt 25 toward the heat roller 21. A center axis C2 of the pressurizing roller 26 is parallel to a center axis C1 of the heat roller 21. The pressurizing roller 26 brings the pressurizing belt 25 into pressurized contact with the heat roller 21. An exit of the fixing nip section is formed by the pressurizing roller 26.

The pressurizing belt heat roller 28 is a cylinder body made of metal such as aluminum or iron. The outer circumferential surface of the pressurizing belt heat roller 28 is covered with a release layer. The release layer is made of fluorocarbon resin, silicon rubber, or the like. The pressurizing belt heat roller 28 incorporates a lamp 33 (a heat source). The pressurizing belt heat roller 28 is heated by the lamp 33. For example, the lamp 33 is a halogen lamp, an IH heater, or the like. The pressurizing belt heat roller 28 heats the pressurizing belt 25. A center axis C3 of the pressurizing belt heat roller 28 is parallel to the center axis C1 of the heat roller 21. The pressurizing belt heat roller 28 is disposed upstream in the conveying direction of the sheet compared with the pressurizing roller 26. The pressurizing belt heat roller 28 may be movable in a direction in which the pressurizing belt heat roller 28 approaches and separates from the pressurizing roller 26. Consequently, it is possible to easily adjust the tension of the pressurizing belt 25.

The pressing unit 22 is capable of turning around a turning fulcrum 35. The turning fulcrum 35 is present in a position away from the heat roller 21. A center axis C4 of the turning fulcrum. 35 is parallel to the center axis C1 of the heat roller 21.

A first direction D1 is a direction in the axial circumferential direction of the turning fulcrum 35. The first direction D1 is a direction in which the pressurizing roller 26 approaches the heat roller 21. A second direction D2 is a direction opposite to the first direction D1 in the axial circumferential direction of the turning fulcrum 35. The second direction D2 is a direction in which the pressurizing roller 26 separates from the heat roller 21.

As shown in FIG. 3, the fixing device 20 allows the sheet, on which an image made with unfixed toner (an unfixed developer image) is transferred, to pass in an arrow direction in the figure. The sheet and the image made with the toner on the sheet pass through a nip between the heat roller 21 and the pressurizing belt 25 to be heated and pressurized. The sheet passing through the nip is heated by the heat roller 21 and the pressurizing belt 25. The image by the toner is fixed on the sheet. The fixing device 20 needs large pressure in the nip compared with the existing fixing device. Therefore, the coating layers of the heat roller 21 and the pressurizing roller 26 have high hardness, having small thickness, and a small crushing amount (compression deformation amount in the thickness direction). For example, in the existing fixing device, the hardness of the coating layer is 50°, the thickness is 5 mm, and the crushing amount is 1.5 mm. On the other hand, in the fixing device 20, the hardness of the coating layer is 81.5°, the thickness is 2 mm, and the crushing amount is 0.3 mm.

Since the fixing device 20 has the small crushing amount of the coating layer, high accuracy is required for positioning of the stopper section 60. If a fastening fixture, a mechanical lock mechanism, or the like is adopted as a structure for positioning the stopper section 60, sufficient positioning accuracy sometimes cannot be obtained. In the fixing device 20, in order to increase a pressurizing force of the pressurizing roller 26 on the heat roller 21, the length from a fulcrum to a power point of a pressurizing arm 53 is large. Therefore, if mechanical distortion of a pressurizing arm 53 is taken into account, after assembling the pressurizing arm 53 taking into account fluctuation, it is necessary to adjust the pressurizing arm 53 for each fixing device.

As shown in FIGS. 6 and 7, the supporting frame 51 includes a main body section 52 and the pressurizing arm 53. The main body section 52 includes an upper frame 57 and a lower frame 58. The upper frame 57 and the lower frame 58 are coupled to each other. For example, the upper frame 57 supports the pressurizing roller 26. For example, the lower frame 58 supports the pressurizing belt heat roller 28. Consequently, the pair of supporting frames 51 supports both end portions of the pressurizing roller 26 and both end portions of the pressurizing belt heat roller 28.

A direction from the turning fulcrum 35 toward a center axis C1 of the heat roller 21 is referred to as forward direction F. The opposite direction of the forward direction F is referred to as backward direction B. A portion of the main body section 52 that supports the pressurizing roller 26 and the pressurizing belt heat roller 28 is referred to as main section 52A.

The pressurizing arm 53 extends generally toward the forward direction F from the main section 52A. One end portion 23*a* of the urging member 23 is coupled to a distal end portion 54 of the pressurizing arm 53.

The urging member 23 urges the pressing unit 22 in the first direction D1. For example, the urging member 23 is a coil spring. The urging member 23 urges the pressurizing roller 26 in the first direction D1. The other end portion 23*b* of the urging member 23 is fixed to a not-shown fixed point.

As shown in FIG. 3, the stopper 60 includes a base body section 61 and a screw shaft section 62.

The base body section 61 has a columnar shape having a center axis C5. For example, the base body section 61 is made of metal such as stainless steel. The shape of a cross section of the base body section 61 orthogonal to the center axis C5 is a noncircular shape. As shown in FIG. 4, for example, the sectional shape of the base body section 61 is a hexagon (a regular hexagon). That is, the base body section 61 has a hexagonal columnar shape (a regular hexagonal columnar shape) having six surface sections 63 (outer surfaces).

The base body section 61 is rotatable around the center axis C5. As shown in FIG. 3, the base body section 61 extends in a direction crossing the center axis C1 of the heat roller 21 and a direction crossing the extending direction of the pressurizing arm 53.

The screw shaft section 62 is formed at one end portion 61*a* of the base body section 61 to project along the center axis C5. For example, the screw shaft section 62 is made of metal such as stainless steel. The screw shaft section 62 is formed integrally with the base body section 61. A male screw is formed on the outer circumferential surface of the screw shaft section 62. The screw shaft section 62 is formed with a distal end portion 62*a* directed to the pressurizing arm 53. The screw shaft section 62 is formed coaxially with the base body section 61.

The screw shaft section 62 is disposed with a gap secured between the distal end portion 62*a* and the pressurizing arm 53. The distance between the distal end portion 62*a* of the screw shaft section 62 and the pressurizing arm 53 is referred to as L1.

The distal end portion 62*a* of the screw shaft section 62 is present in a position where the pressurizing arm 53 comes into contact the distal end portion 62*a* if the pressurizing arm 53 turns in the first direction D1 of the pressing unit 22. Therefore, the screw shaft section 62 is present in a position where the screw shaft section 62 can regulate the movement of the pressing unit 22 in the first direction D1. Therefore, the stopper section 60 can limit a movable distance (or turning angle) in the first direction D1 of the pressing unit 22.

The rotation regulating section 70 is made of a wire rod or a bar stock. For example, the rotation regulating section 70 is made of metal such as stainless steel. For example, the rotation regulating section 70 is formed in a U shape. The rotation regulating section 70 includes a first main section 71, a second main section 72, and a coupling section 73. Proximal end portions 71*a* and 72*a* of the first main section 71 and the second main section 72 are fixed to the fixed frame 80. The first main section 71 and the second main section 72 extend from the fixed frame 80 in a direction crossing the base body section 61 of the stopper 60. The first main section 71 and the second main section 72 are substantially parallel to each other. The coupling section 73 couples the first main section 71 and the second main section 72. The rotation regulating section 70 extends in a direction crossing the base body section 61. The rotation regulating section 70 is a spring material urged toward the base body section 61.

As shown in FIG. 4, the rotation regulating section 70 comes into contact with the base body section 61 of the stopper section 60. The rotation regulating section 70 comes into contact with the base body section 61 in a state in which the rotation regulating section 70 presses the base body section 61 with a bending elastic force. The rotation regulating section 70 can linearly or planarly come into contact with the base body section 61. That is, if taking a posture along the surface section 63, the rotation regulating section 70 can come into contact with the surface section 63 over the length direction or the surface direction.

Among the surface sections 63 of the base body section 61 of the stopper section 60, the surface section 63 opposed to the rotation regulating section 70 is referred to as surface section 63A. If an angle between the surface section 63A and the rotation regulating section 70 is small (see FIG. 4), a bend of the rotation regulating section 70 is small and an elastic repulsion force is also small. On the other hand, if the angle between the surface section 63A and the rotation regulating section 70 is large (see FIG. 5), the bend of the rotation regulating section 70 is large and the elastic repulsion force is also large. Therefore, the stopper section 60 is more stable in the posture shown in FIG. 4. Therefore, the rotation regulating section 70 can regulate the rotation of the stopper section 60 that takes the posture shown in FIG. 4.

As shown in FIG. 3, the fixed frame 80 is formed independently from the supporting frame 51. The fixed frame 80 includes a first frame 81 and a second frame 82 present in different positions in the length direction of the stopper 60.

The first frame 81 includes a screw hole 83 in which the screw shaft section 62 of the stopper section 60 is fit. An outer surface 81*a* of the first frame 81 is opposed to the pressurizing arm 53.

The screw hole 83 is formed to pierce through the first frame 81 in the thickness direction. On the inner circumferential surface of the screw hole 83, a female screw that is screwed over the male screw of the screw shaft section 62 is formed. Since the screw shaft section 62 is screwed and fit in the screw hole 83, the screw shaft section 62 is positioned in the center axis C5 direction. The screw shaft section 62 projects from the outer surface 81*a* of the first frame 81 toward the pressurizing arm 53.

If the stopper section 60 is rotated around the center axis C5, since a fitting position of the screw shaft section 62 in the screwhole 83 changes, the height position (the position in the center axis C5 direction) of the stopper section 60 changes. Therefore, it is possible to adjust the distance L1 between the distal end portion 62*a* of the screw shaft section 62 and the pressurizing arm 53.

In the second frame 82, an insert-through hole 84, through which the base body section 61 of the stopper section 60 is inserted, is formed. The insert-through hole 84 is formed to pierce through the second frame 82 in the thickness direction. The inner diameter of the insert-through hole 84 is set such that the rotation of the base body section 61 is not hindered. The insert-through hole 84 can regulate the movement in the radial direction of the base body section 61.

If the coating layer of the pressurizing roller 26 is deteriorated by aging to be thin, the inter-axis distance between the pressurizing roller 26 and the heat roller 21 decreases. Therefore, it is likely that the nip width increases, creases occur on the sheet, and the sheet tilts.

On the other hand, the fixing device 20 includes the stopper section 60 including the base body section 61 having the noncircular cross section and the rotation regulating section 70 that regulates the rotation of the stopper section 60. By regulating the rotation of the stopper section 60, the rotation regulating section 70 can regulate the movement in the height direction (the direction along the center axis C5) of the stopper section 60 and maintain the height position of the stopper section 60 in a height position during manufacturing (during factory shipment).

Therefore, the movable distance (turning angle) in the first direction D1 of the pressing unit 22 due to the decrease in the thickness of the coating layer of the pressurizing roller 26 can be limited to a predetermined range by the stopper section 60. An upper limit of the movable distance (turning angle) in the first direction D1 of the pressing unit 22 can be decided by setting, as an indicator, a distance at which creases and a tilt of the sheet do not occur. Therefore, it is possible to prevent deficiencies such as the creases and the tilt of the sheets.

The stopper section 60 is rotatable around the center axis C5. Therefore, for example, if the pressurizing roller 26, the coating layer of which is deteriorated, is replaced with a new pressurizing roller 26 having different specifications, it is possible to set the height position of the stopper section 60 again.

With the fixing device 20, compared with when fastening by a fixture, fixing by a mechanical lock mechanism, or the like is adopted as a method of positioning the stopper section 60, manufacturing is facilitated. Maintenance is also facilitated.

The base body section 61 of the stopper section 60 has a polygonal columnar shape (a hexagonal columnar shape). Therefore, it is possible to regulate the rotation of the stopper section 60 making use of an elastic repulsion force of the rotation regulating section 70 changing according to the angle between the surface section 63 of the base body section 61 and the rotation regulating section 70. Since the structure of the base body section 61 is simple in this configuration, this configuration is advantageous in terms of acquisition easiness of components and manufacturing cost. In particular, the hexagonal columnar base body section 61 is easily acquired. Therefore, manufacturing cost can be reduced.

The rotation regulating section 70 can be linearly or planarly come into contact with the base body section 61. Therefore, the rotation regulating section 70 can stabilize the posture of the stopper section 60 and surely regulate the rotation of the stopper section 60.

The rotation regulating section 70 is a spring material urged toward the base body section 61 of the stopper section 60. Therefore, the rotation regulating section 70 can stabilize the posture of the stopper section 60 with an elastic force and surely regulate the rotation of the stopper section 60.

The rotation regulating section 70 is a wire rod or a bar stock extending in the direction orthogonal to the base body section 61. Therefore, the rotation regulating section 70 can come into contact with the surface section 63 of the base body section 61 and stabilize the posture of the stopper section 60.

The screw shaft section 62 is disposed with a gap secured between the distal end portion 62*a* and the pressurizing arm 53. Therefore, the screw shaft section 62 can allow a certain degree of movement in the first direction D1 of the pressing unit 22. Therefore, it is possible to set a usable period (a period of endurance) of the pressurizing roller 26 long.

The fixing device 20 includes the fixed frame 80 including the screw hole 83 in which the screw shaft section 62 is fit. Therefore, it is possible to easily decide the distance of the screw shaft section 62 from the pressurizing arm 53 according to a fitting position of the screw shaft section 62 in the screw hole 83.

The fixed frame 80 includes the insert-through hole 84 through which the base body section 61 is inserted. Therefore, the fixed frame 80 can prevent tilting of the stopper section 60. Therefore, it is possible to cause the stopper section 60 to stably operate.

Note that the sectional shape of the base body section 61 of the stopper section 60 is not limited to the hexagon.

Figure 8:
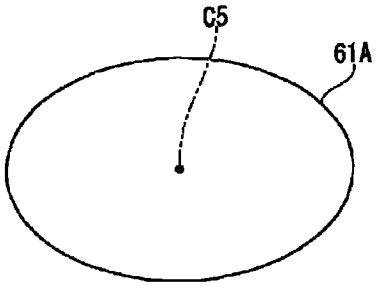
FIG. 8 is a schematic diagram showing a first modification of the stopper section of the fixing device.

In FIG. 8, a base body section 61A, the shape of a cross section of which orthogonal to the center axis C5 is an ellipse, is shown.

Figure 9:
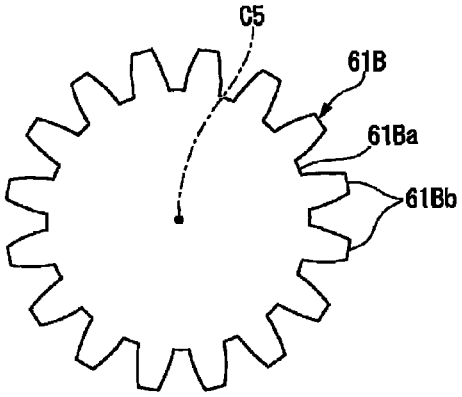
FIG. 9 is a schematic diagram showing a second modification of the stopper section of the fixing device.

In FIG. 9, a base body section 61B, the shape of a cross section of which orthogonal to the center axis C5 is a gear shape, is shown. The base body section 61B includes a main section 61Ba circular in section and includes, on the outer circumferential surface of the main section 61Ba, a plurality of projecting sections 61Bb projecting outward in the radial direction of the main section 61Ba. The projecting sections 61Bb are formed over the entire circumference of the main section 61Ba at an interval in the circumferential direction of the main section 61Ba. The projecting sections 61Bb have a trapezoidal shape gradually narrowing in width in the projecting direction.

The sectional shape of the base body section 61 may be a polygon (an n-sided polygon: n is an integer equal to or larger than 3) other than the hexagon. Examples of the polygon include a triangle, a square, a pentagon, a heptagon, and an octagon.

The rotation regulating section is not limited to the wire rod or the bar stock and may be made of a plate material. In that case, the plate material may be a leaf spring urged toward the base body section of the stopper section.

If the rotation regulating section is a spring material, in a posture in which the rotation regulating section is in contact with the surface section of the base body section, the rotation regulating section does not have to be bent and deformed. An elastic force does not have to be generated.

In the embodiment, the pressurizing belt heat roller is adopted as the belt supporting member. However, the belt supporting member is not limited to a roller and may be a non-rotating body.

According to the at least one embodiment explained above, the fixing device 20 includes the stopper section 60 including the base body section 61 having the noncircular cross section and the rotation regulating section 70 that regulates the rotation of the stopper section 60. By regulating the rotation of the stopper section 60, the rotation regulating section 70 can regulate the movement in the height direction (the direction along the center axis C5) of the stopper section 60 and maintain the height position of the stopper section 60 in a height position during manufacturing (during factory shipment). Therefore, with the stopper section 60, it is possible to limit a movable distance (or turning angle) in the first direction D1 of the pressing unit 22 due to a reduction in the thickness of the coating layer of the pressurizing roller 26 within a predetermined range. Therefore, it is possible to prevent deficiencies such as creases and a tilt of the sheet.

The stopper section 60 is rotatable around the center axis C5. Therefore, if the pressurizing roller 26, the coating layer of which is deteriorated, is replaced with a new pressurizing roller 26 having different specifications, it is possible to set the height position of the stopper section 60 again.

With the fixing device 20, compared with when fastening by a fixture, fixing by a mechanical lock mechanism, or the like is adopted as a method of positioning the stopper section 60, manufacturing is facilitated. Maintenance is also facilitated.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. A fixing device comprising:

a first rotating body heated by a heat source;

a pressing unit including a belt opposed to an outer circumferential surface of the first rotating body, a second rotating body, around an outer circumferential surface of which the belt is wound, and a supporting frame configured to support the second rotating body;

an urging member configured to urge the pressing unit in a direction in which the second rotating body approaches the first rotating body;

a base body section rotatable around an axis, a shape of a cross section of the base body section orthogonal to an axial direction being a noncircular shape;

a screw shaft section configured to project from the base body section and regulate a movement of the pressing unit in a direction in which the pressing unit approaches the first rotating body; and a rotation regulating section configured to come into contact with an outer surface of the base body section to regulate the rotation of the base body section.

2. The device according to claim 1, wherein the base body section has a polygonal columnar shape, the shape of the cross section of which is a polygon.

3. The device according to claim 1, wherein the rotation regulating section is linearly or planarly in contact with the outer surface of the base body section.

4. The device according to claim 1, wherein the rotation regulating section is a spring material urged toward the base body section.

5. The device according to claim 1, wherein the rotation regulating section is a wire rod or a bar stock extending in a direction crossing the base body section.

6. The device according to claim 1, wherein the screw shaft section is disposed with a gap secured between the screw shaft section and the pressing unit.

7. The device according to claim 1, further comprising a fixed frame including a screw hole in which the screw shaft section is fit.

8. The device according to claim 7, wherein the fixed frame includes an insert-through hole through which the base body section is inserted.

9. The device according to claim 1, wherein the base body section is a hexagonal columnar shape, the shape of the cross section of which is a hexagon.

10. An image forming apparatus comprising:

an image forming section configured to form, on the sheet, a toner image made with toner; and the fixing device according to claim 1.

* * * * *